US005785613A

United States Patent [19]

Francis

[11] Patent Number: 5,785,613

[45] Date of Patent: Jul. 28, 1998

[54] HOPSCOTCH GAME

[76] Inventor: Elizabeth Francis, 1138 E. 103rd St., Brooklyn, N.Y. 11236

[21] Appl. No.: 629,849

[22] Filed: Apr. 9, 1996

[51] Int. Cl.[6] ..... A63B 67/00

[52] U.S. Cl. ..... 473/414

[58] Field of Search ..... 273/57.1; 473/414

[56] References Cited

U.S. PATENT DOCUMENTS

| | | | |
|---|---|---|---|
| 2,891,793 | 6/1959 | Mudry | 273/57.1 |
| 3,091,454 | 5/1963 | Sam | 473/414 |
| 3,136,545 | 6/1964 | Stokes | 273/57.1 |
| 3,139,281 | 6/1964 | Nicholson | 273/57.1 |
| 3,515,385 | 6/1970 | Gunderson | 273/57.1 |
| 3,768,809 | 10/1973 | Clarfello | 273/57.1 |
| 4,078,793 | 3/1978 | Allen | 437/414 |
| 4,733,864 | 3/1988 | Casteel | 473/414 |
| 4,848,743 | 7/1989 | Rozek | 273/57.1 |
| 5,102,129 | 4/1992 | Roberts | 273/57.1 |
| 5,156,409 | 10/1992 | Barnes | 273/57.1 |

*Primary Examiner*—Theatrice Brown

[57] ABSTRACT

The hopscotch game of the invention includes a housing having positioned thereon sequentially numbered spaces projecting above a top surface of the housing, such that sequential players direct playing pieces onto the spaces in a sequential manner skipping over spaces upon which the playing disc has been directed. Flashing illumination and audio signal generator structure is provided to be discontinued when a player has finished a turn.

3 Claims, 3 Drawing Sheets

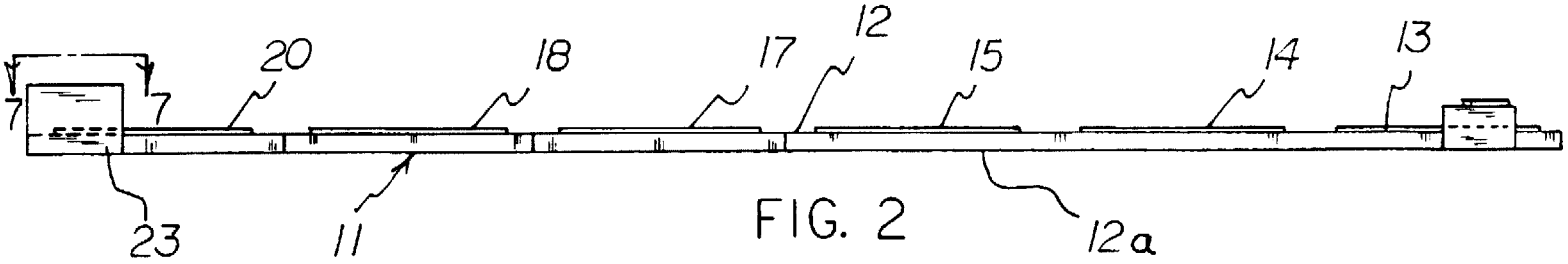
FIG. 2
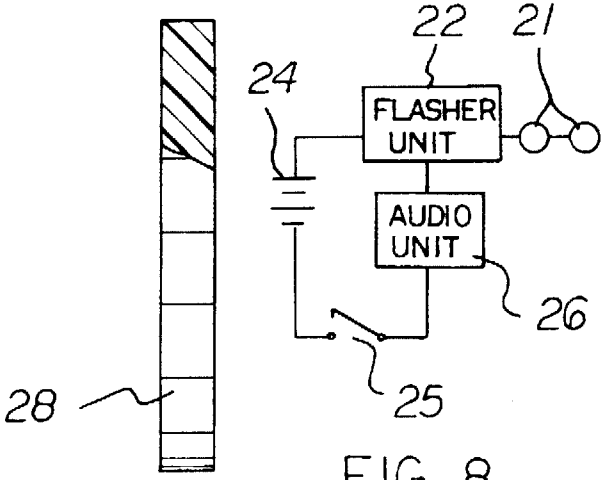
FIG 8
FIG. 4
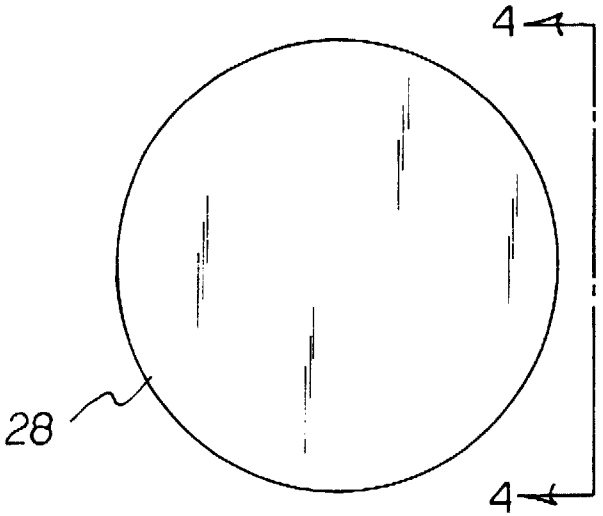
FIG. 3

HOPSCOTCH GAME

TECHNICAL FIELD

A hopscotch game mounted to a housing includes a plurality of spaces upon which sequential players direct a playing disc sequentially along the numbered spaces to direct the disc in a sequential manner along the spaces for removal.

BACKGROUND OF THE INVENTION

Prior art hopscotch games and the like are exemplified by U.S. Pat. Nos. 3,515,385; 3,635,474; 3,879,034; 5,102,129; and U.S. Design Pat. No. 343,644.

SUMMARY OF THE INVENTION

The hopscotch game of the invention includes a housing having positioned thereon sequentially numbered spaces projecting above a top surface of the housing, such that sequential players direct playing pieces onto the spaces in a sequential manner skipping over spaces upon which the playing disc has been directed. Flashing illumination and audio signal generator structure is provided to be discontinued when a player has finished a turn.

Objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 2 is a side view, taken in elevation, of the invention.

FIG. 3 is a top plan view of the playing disc utilized by the invention.

FIG. 4 is a side view, partially in section, of the playing disc.

FIG. 8 is an electrical schematic illustration as employed by the invention.

DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
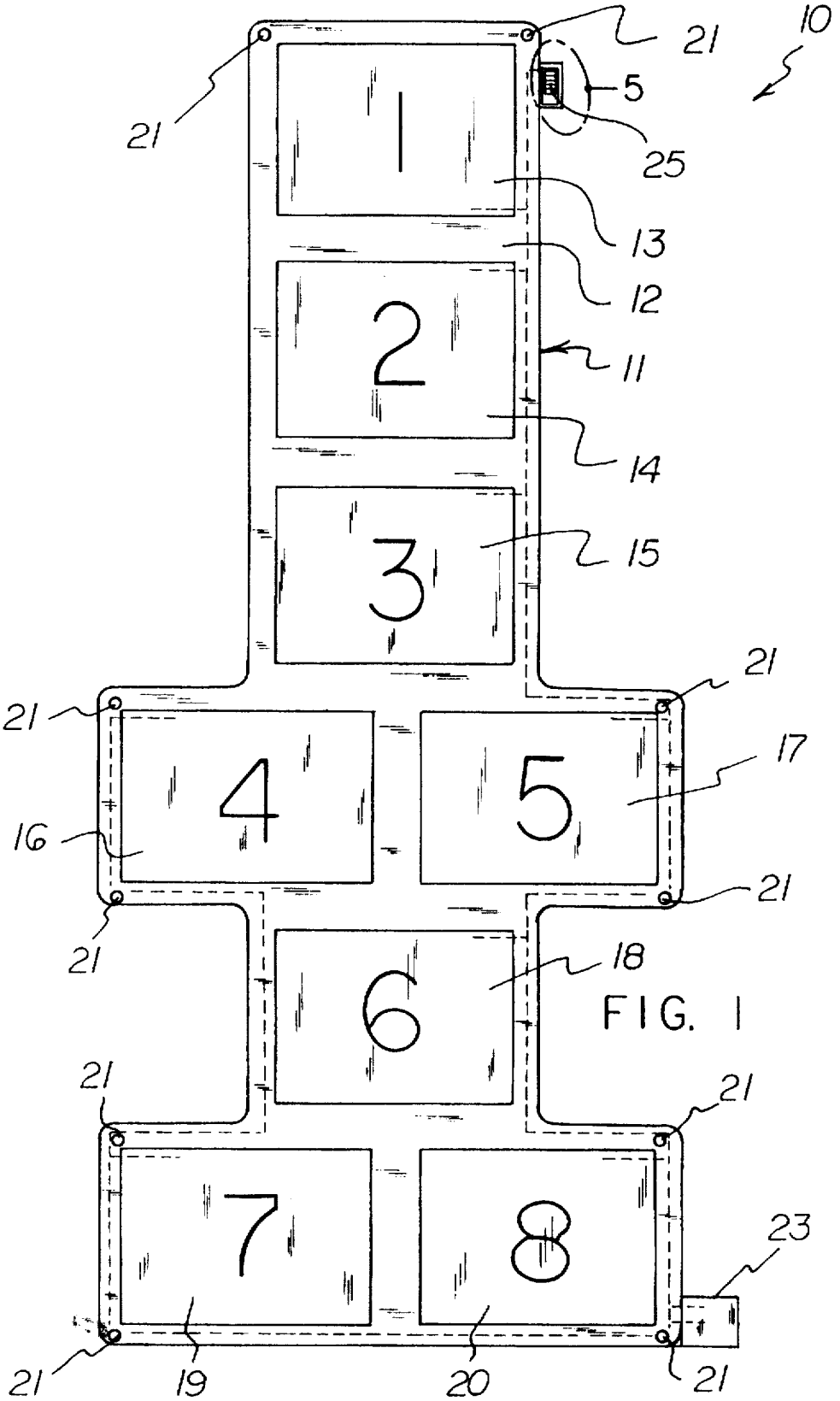
FIG. 1 is a top plan view of the invention.
Figure 5:
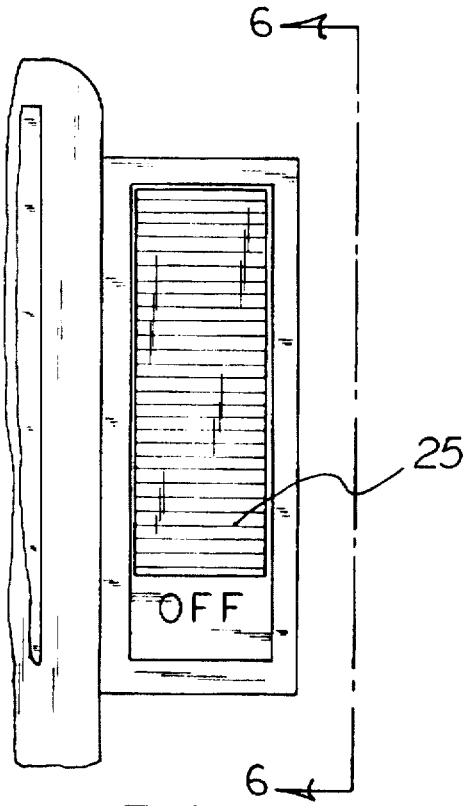
FIG. 5 is an enlarged, top plan view of section 5 as set forth in FIG. 1.
Figure 6:
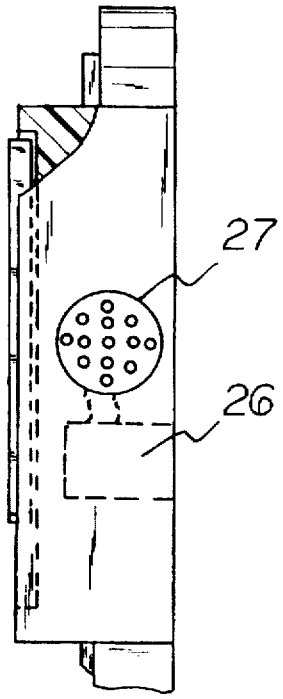
FIG. 6 is a side view, partially in section, taken along the lines 6—6 as indicated in FIG. 5.
Figure 7:
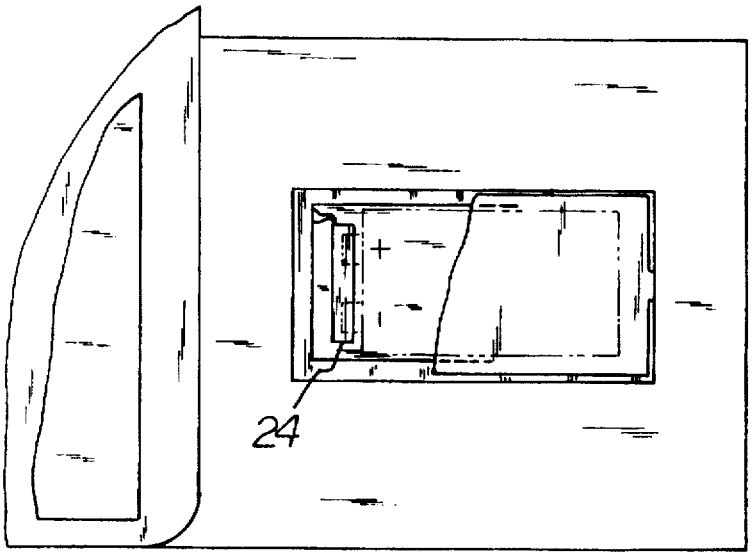
FIG. 7 is a top view, as indicated in FIG. 2, taken along the lines 7—7.

The hopscotch game 10 of the invention comprises a unitary housing 11 having a top wall 12 spaced from a bottom wall **12*a* upon which the housing is positioned, such as indicated in the FIG. 2 for example. A plurality of playing areas or spaces 13–20 are provided and are sequentially numbered 1–8, respectively include a plurality of initial spaces 13, 14, and 15 which are numbered 1, 2, and 3, respectively. Each of the initial spaces 13–15 projects above the top wall 12 in a coplanar relationship and are arranged in a predetermined linear alignment, such as indicated in FIG. 1. A plurality of further spaces 16 and 17 on which are numbered 4 and 5, respectively, are provided and extend laterally of the initial spaces 13–15 each side of that linear alignment, with a yet further space 18 numbered 6, positioned on an opposed side of the further spaces 16 and 17 relative to the initial spaces 13–15. The space 18 is in linear alignment, numbered 7 and 8, respectively, with initial spaces 13–15. A plurality of final spaces 19 and 20 extend laterally in a like manner as do the further spaces 16 and 17 and are medially bisected by the linear alignment of initial spaces 13–15 and yet further space 18. To this end, an individual employs a playing disc 28, such as indicated in FIGS. 3 and 4, and directs the playing disc onto the first space 13. The player then skips over the first space 13 landing on the second space 14, the third space 15, with a single foot in each space 14 and 15. Upon reaching the fourth and fifth spaces 16 and 17, the player may position one foot on each of said fourth and fifth spaces 16 and 17 to thereby not have to balance. A player then is directed onto the sixth space 18 on one foot, to the seventh and eighth spaces 19 and 20 simultaneously, and will then turn around on the seventh and eighth spaces. When the player descends the spaces to the first space 13 by landing upon the second space 14, the player will bend over, lift upon the playing piece and disengage from the playing board or housing 11**. This pattern is sequentially repeated as the playing disc is directed onto the second, third, fourth, etc. spaces in turn. A player will not land upon the space with a playing disc thereon, but must bend over to pick up that piece when descending the board. A preferential rule of the game is such that when a player has completed directing the playing piece onto all of the spaces, the first player to do so may choose one of the spaces, whereupon that player may utilize that space by landing with both feet in that space as a further space of rest. The player having won the most spaces may be declared a winner in this manner.

To enhance enjoyment of the game, when each player is traversing the board, that player turns on the on/off switch 25 that is integral to a side wall of the housing 11. The on/off switch operates an audio unit 26 directing such audio signals through a speaker 27. The signals may be in the form of a tone, a buzzer, or a predetermined or prerecorded musical audio signal in electrical communication with a battery housing 23 having at least one battery 24. Further, a plurality of flashing illumination bulbs 21, which may be in the form of neon lights and the like, are directed about various portions of the perimeter of the top wall 12 to permit play of the game even during periods of limited available light, as well as enhancing visual enjoyment in use of the game.

It is to be understood that while certain forms of the present invention have been illustrated and described herein, it is not to be limited to the specific forms or arrangement of parts described and shown.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed and desired to be protected by Letters Patent of the United States is as follows:

1. A hopscotch game, comprising, a playing board, the playing board having a top wall spaced from a bottom wall, and the top wall having a first end spaced from a second end and a continuous side wall, wherein a plurality of spaces project from the top wall, wherein the spaces are arranged in a coplanar relationship relative to one another and include a plurality of initial spaces arranged in a predetermined linear alignment extending from the first end along the top wall, a plurality of further spaces extend laterally of the initial spaces, the further spaces being medially bisected by the linear alignment of the initial spaces, with at least a yet further space positioned in linear alignment with the initial spaces and positioned on an opposed side of the further spaces, a plurality of final spaces extending laterally of the initial and yet further spaces, the final spaces being medially bisected by the linear alignment of the initial and yet further spaces, and illumination means positioned about a peripheral portion of the playing board to indicate an illuminated outline of the slaying board.

2. A hopscotch game as set forth in claim 1 further including a battery housing having at least one battery, an on/off switch secured to the side wall, and the on/off switch in electrical communication with the battery housing and the battery, and wherein the illumination means includes a plurality of flashing illumination bulbs in electrical communication with the on/off switch, the bulbs projecting through the top wall and being spaced about the peripheral portion of the playing board.

3. A hopscotch game as set forth in claim 2 wherein an audio unit is in electrical communication with the battery housing, the battery and the on/off switch, with the audio unit having at least one speaker in electrical communication with the on/off switch.

* * * * *